US006059160A

United States Patent [19]

Longrod

[11] Patent Number: 6,059,160

[45] Date of Patent: May 9, 2000

[54] RECEIPT PRINTING AND DISCHARGE MECHANISM

[75] Inventor: Scott Longrod, Lansing, N.Y.

[73] Assignee: Axiohm Transaction Solutions, Inc., Blue Bell, Pa.

[21] Appl. No.: 09/041,489

[22] Filed: Mar. 12, 1998

[51] Int. Cl.[7] ..... G03B 1/56; B65H 43/00; B65H 23/32

[52] U.S. Cl. ..... 226/12; 226/91; 242/615.21; 242/615.3

[58] Field of Search ..... 242/615.21, 564.3, 242/566, 615.3; 226/91, 172, 12, 196.1

[56] References Cited

U.S. PATENT DOCUMENTS

| | | | |
|---|---|---|---|
| 2,783,041 | 2/1957 | Merritt et al. | 226/172 X |
| 3,548,783 | 12/1970 | Knapp | 242/615.21 X |
| 3,885,756 | 5/1975 | Uehara et al. | 226/91 X |
| 4,145,039 | 3/1979 | Carlsson | 226/172 X |
| 4,154,386 | 5/1979 | Kawada | 226/91 |
| 4,162,786 | 7/1979 | Bullock | 242/615.21 X |
| 4,695,954 | 9/1987 | Rose et al. | 364/413 |
| 5,148,944 | 9/1992 | Kausman et al. | 221/131 |
| 5,317,358 | 5/1994 | Kawada | 242/615.3 X |
| 5,879,090 | 3/1999 | Hoyt et al. | 400/578 |

*Primary Examiner*—Michael R. Mansen
*Attorney, Agent, or Firm*—Salzman & Levy

[57] ABSTRACT

A media presenting device that allows for the presenting of various media, such as receipts, slips, forms, labels, tickets, tags, etc. The media are introduced into the device by an adjacently disposed printer or supply roll of paper. The web of the paper enters a curved raceway of a presenting device and is folded upon itself, thereby changing its direction by ninety degrees with respect to the normal flow direction.

6 Claims, 4 Drawing Sheets

RECEIPT PRINTING AND DISCHARGE MECHANISM

RELATED PATENT APPLICATION

This application is related to U.S. patent application, Ser. No. 08/965,710, assigned to a common assignee, entitled RECEIPT PRINTING, STORAGE AND DISCHARGING MECHANISM, now U.S. Pat. No. 5,879,090; issued Mar. 9, 1999, to a common assignee.

FIELD OF THE INVENTION

This invention relates to receipt printing and handling devices and, more particularly, to a receipt printing and presenting mechanism for printing a plurality of transactions upon a continuous web and thereafter discharging the receipt web at an angle perpendicular to the normal discharge direction.

BACKGROUND OF THE INVENTION

Retail establishments usually print receipts of the sales transactions upon a supply roll of paper. Very often, a plurality of transactions cause the printing of a lengthy receipt document. The long document presents an unwieldy and unmanageable web that is both unsightly and cumbersome to handle. The lengthy receipt web will often drape awkwardly from the print register and interfere with the entering of additional transactions and the summing of the final receipt total.

It would be desirable to provide a means by which the lengthy web can be contained temporarily, or diverted until the completion of the printing and cutting of the receipt.

It would additionally be an benefit to provide a mechanism wherein a lengthy receipt can be discharged at a right angle to the normal discharge direction, so as not to interfere with the keyboard or face of the register.

The present invention seeks to provide a device that diverts a lengthy print receipt web as it is discharged from the printer. The receipt web is discharged from the printer to a curved raceway. There, the receipt web is forced to fold upon itself and change direction. The web is discharged at the right of the housing, in one embodiment, thus leaving the face of the register keyboard unobstructed. In this manner, the front of a register is not encumbered by a long, suspended, receipt web.

In the aforementioned, copending application, a receipt web is discharged to a storage housing. After the receipt is stored, the housing is rotated, and the receipt is discharged at a right angle with respect to the initial web flow direction.

SUMMARY OF THE INVENTION

In accordance with the present invention, there is provided a presenting mechanism that discharges a printed receipt, label, ticket, or form at an angle to the issuing direction. The receipt mechanism comprises a printer, a paper transport section or web conveyor, and a ninety-degree raceway that is disposed adjacent the front housing of a receipt printer. The receipt is dispensed as a continuous web from the receipt printer and drops upon the adjacent paper web transport. The receipt is carried by the web transport to the curved raceway, where it is forced to fold upon itself and change direction. The receipt is then discharged through a slot in the receipt bezel disposed on the side of the receipt printing machine. In another embodiment of this invention, the curved raceway can be used to redirect the web of paper being supplied by a paper supply roll.

It is an object of this invention to provide a device for redirecting a web of paper.

It is another object of the invention to provide an improved presenting mechanism.

BRIEF DESCRIPTION OF THE DRAWINGS

A complete understanding of the present invention may be obtained by reference to the accompanying drawings, when considered in conjunction with the subsequent detailed description, in which.

For the purposes of brevity and clarity, like elements and components will bear the same numbering and designation throughout the figures.

DESCRIPTION OF THE PREFERRED EMBODIMENT

Generally speaking, the invention features a media presenting device. The device allows for the presenting of various media, such as receipts, slips, forms, labels, tickets, tags, etc. The media are introduced into the device by an adjacently disposed printer or supply roll of paper. The web of the paper enters a curved raceway of a presenting device and is folded upon itself, thereby changing its direction by ninety degrees with respect to the normal flow direction. It should be understood that any reasonable angle, other than 90°, can also be accommodated.

Figure 1:
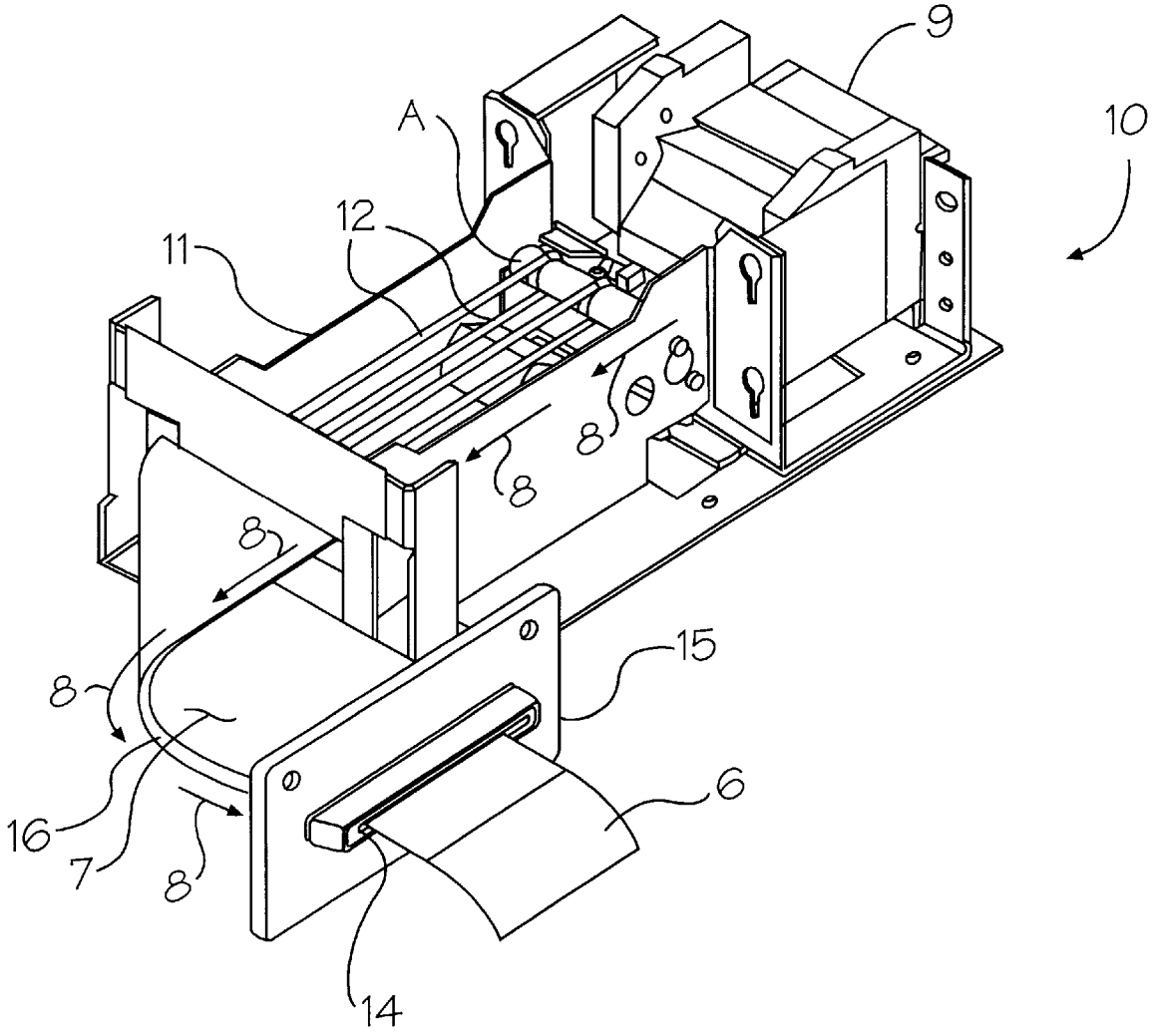
FIG. 1 illustrates a perspective view of the receipt presenter device of the invention.

Now referring to FIG. 1, a perspective view of a printer mechanism 9 is illustrated. The printer 9 is shown discharging a receipt web 6 (arrows 8) to a raceway 7 of the presenting device 10 of this invention. The device 10 is shown having a paper transport 11, which contains a feed roller "A" that drives a plurality of flexible supporting belts 12. The paper transport 11 conveys the printed receipt web 6 upon the belts 12 to the raceway 7, which causes the receipt to fold upon itself by virtue of its curved surface 16. The web 6 is then discharged through a slot 14 in a receipt bezel 15.

Figure 3:
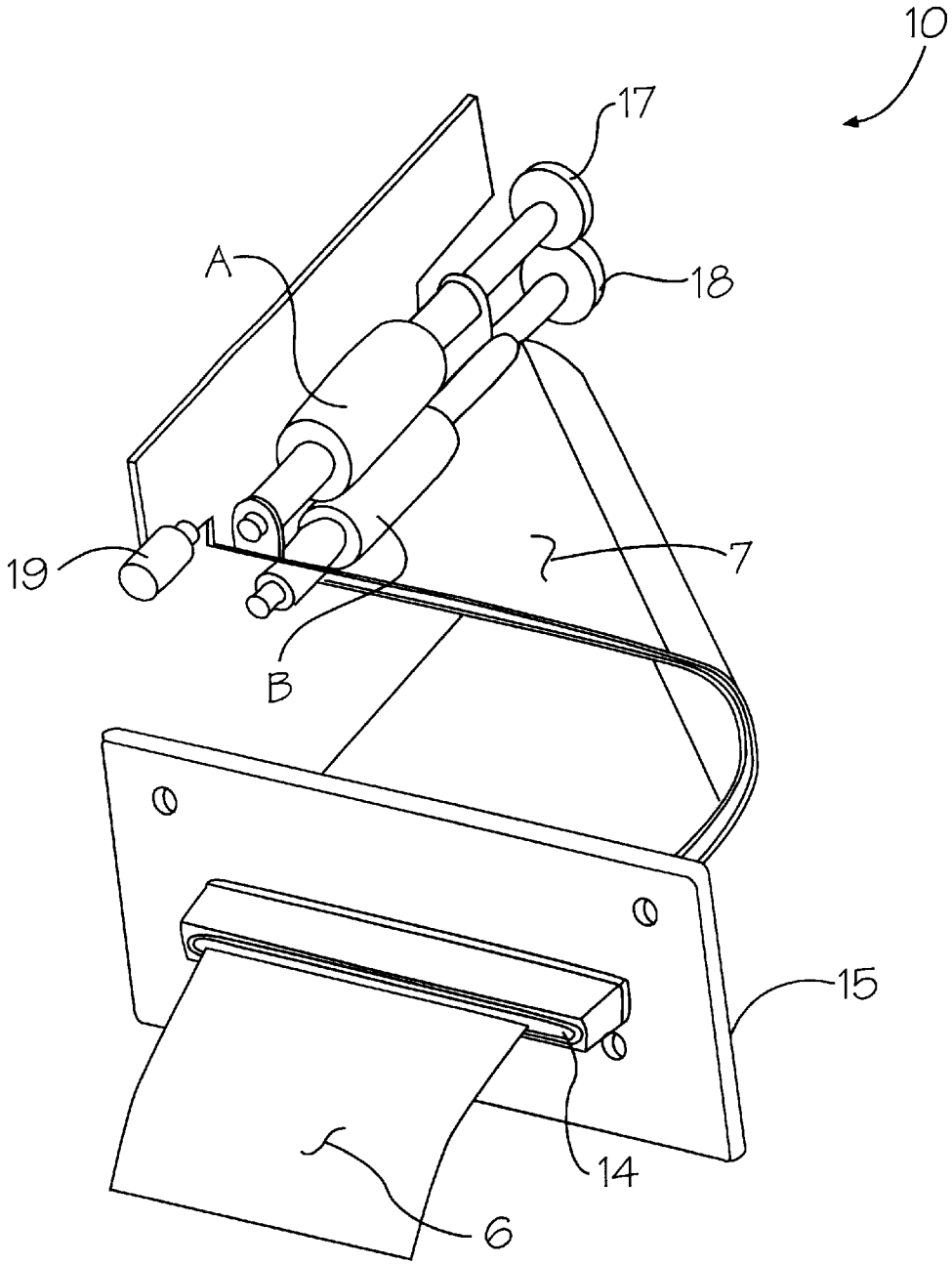
FIG. 3 shows a partial perspective view of the receipt presenter device of FIG. 2, with powered drive rollers.

The printed data on web 6 faces downwardly as it exits the receipt bezel 15. The paper receipt web 6 can also be power driven, as illustrated in the alternate embodiment of FIG. 3. In this embodiment, the presenting device 10 comprises a pair of powered feed rollers "A" and "B" that are in pressure contact with each other. The feed rollers "A" and "B" are driven by a pair of gears 17 and 18 that are powered by a motor (not shown). The discharged slip or web 6 is discharged by printer 9 into the nip of rollers "A" and "B", and is then fed to the curved raceway 7 for angular discharge.

A sensor 19 disposed ahead of the rollers "A" and "B" senses the presence of the receipt web 6 as it exits the printer 9. The sensor 19 sends a signal to actuate the motor into driving the gears 17 and 18 and, hence, the rollers "A" and "B".

Figure 2:
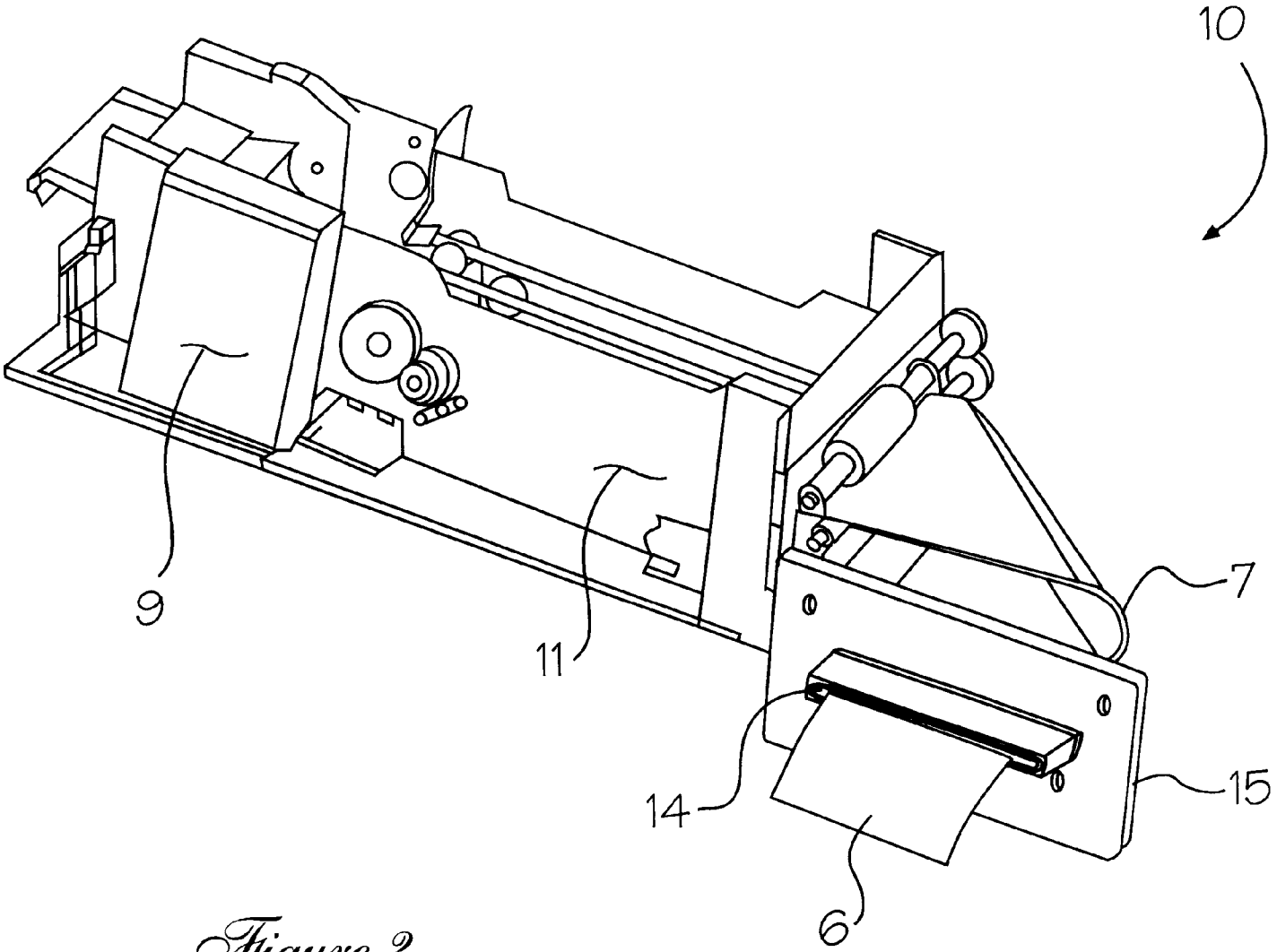
FIG. 2 depicts a perspective view of an alternate embodiment of the receipt presenter shown in FIG. 1.

Referring to FIG. 2, the receipt web 6 is shown being presented (discharged) from the raceway 7 of the presenting device 10 at right angle to the flow direction 8, and to the left of the transport 11. It will be observed that the raceway 7 is now curved in the direction opposite to that shown in FIG. 1. It should be obvious that the raceway 7 can be designed to discharge the web 6 either to the right or to the left, depending upon design preference. The preferred angle of discharge is ninety degrees, but the raceway 7 can direct the web 6 along a curve less than ninety degrees, if so desired.

Figure 4:
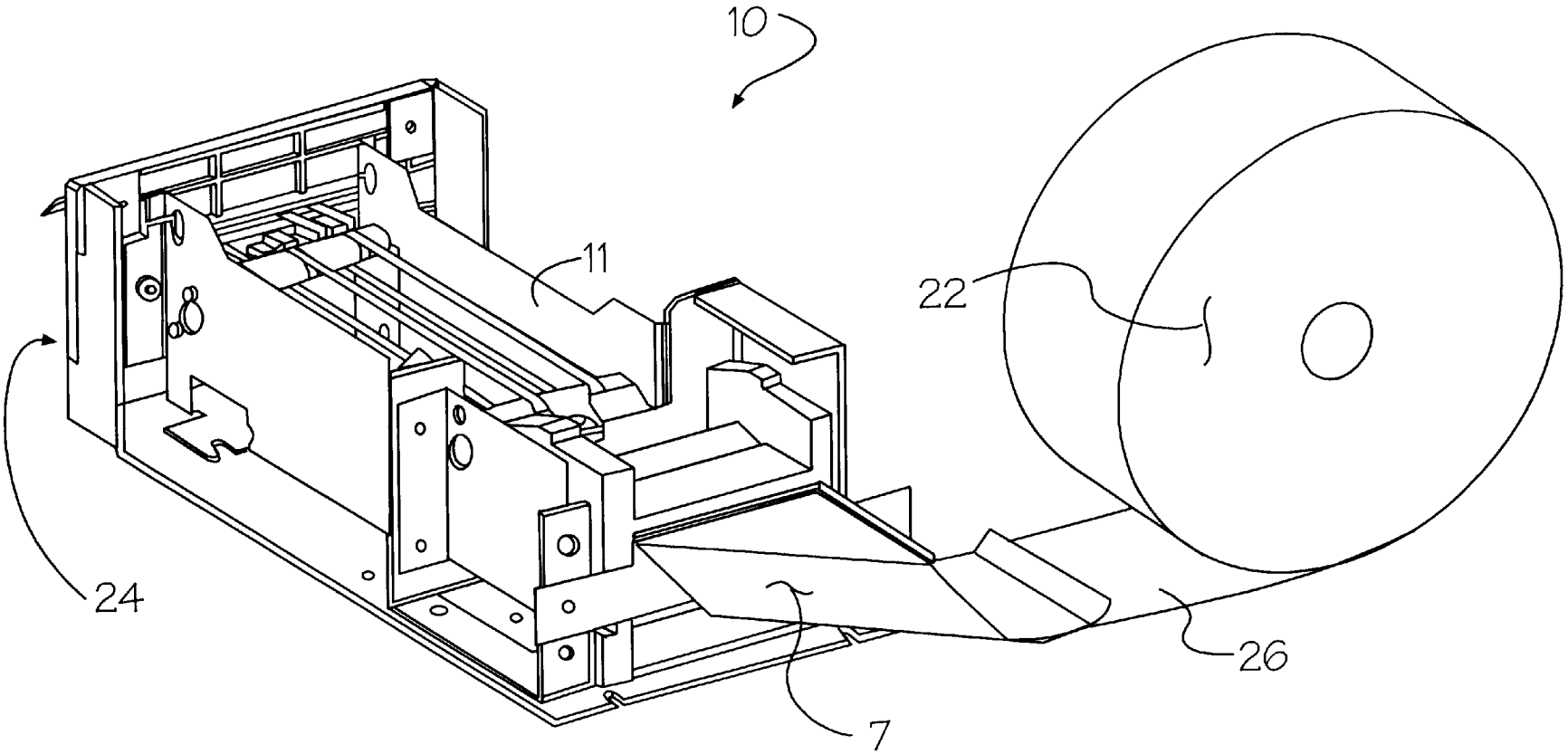
FIG. 4 illustrates a perspective view of the device used as a presenter for a web of paper being supplied from a supply roll to a printer.

Referring to FIG. 4, the presenting device 10 can be used to discharge a plain paper web 26 to curved raceway 7 and transport 11, from the supply roll 22, as illustrated. In this fashion, the supply paper 26 can be fed at right angles to the normal flow direction, exiting at exit end 24, comprising the printer 9 (not shown here).

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A receipt printing and presenting device, comprising:

means defining a flow path for printed receipt material;

a receipt printer disposed alone said flow path for printing printed receipt material;

conveying means disposed adjacent said flow path for conveying said printed receipt material along said flow path;

a curved raceway disposed adjacent said conveying means for receiving said printed receipt material, said curved raceway forcing said media material to fold over upon itself, thus discharging said printed receipt material from said curved raceway at an angle with respect to a flow direction; and a sensor disposed adjacent said conveying means for sensing a leading edge of said printed receipt material in order to actuate said conveying means.

2. The receipt printing and presenting device in accordance with claim 1, wherein said conveying means further comprises a pair of feed rollers for moving said printed receipt material along said flow path.

3. The receipt printing and presenting device in accordance with claim 2, wherein said conveying means comprises a pair of drive gears disposed adjacent said feed rollers for driving said printed receipt material along said feed path.

4. The receipt printing and presenting device in accordance with claim 1, wherein said conveying means comprises a plurality of aligned belts for supporting said printed receipt material.

5. The receipt printing and presenting device in accordance with claim 1, wherein said printed receipt material comprises a web of receipt paper.

6. The receipt printing and presenting device in accordance with claim 5, further comprising a roll of supply paper disposed adjacent said curved raceway.

* * * * *